United States Patent [19]

Suskind et al.

[11] Patent Number: 4,808,467

[45] Date of Patent: Feb. 28, 1989

[54] HIGH STRENGTH HYDROENTANGLED NONWOVEN FABRIC

[75] Inventors: Stuart P. Suskind, Greer; Susan L. K. Martucci, Simpsonville; Joseph Israel, Greenville, all of S.C.

[73] Assignee: James River Corporation of Virginia, Richmond, Va.

[21] Appl. No.: 97,157

[22] Filed: Sep. 15, 1987

[51] Int. Cl.[4] ..... B32B 27/34

[52] U.S. Cl. ..... 428/284; 28/104; 28/105; 428/286; 428/287; 428/288; 428/296; 428/299; 428/301; 428/421; 428/422

[58] Field of Search ..... 428/284, 286, 287, 288, 428/296, 299, 301; 28/104, 105; 424/421, 422

[56] References Cited

U.S. PATENT DOCUMENTS 4,144,370 3/1979 Boulton ..... 428/299
4,612,237 9/1986 Frankenburg ..... 428/299

*Primary Examiner*—Marion C. McCamish
*Attorney, Agent, or Firm*—William A. Aguele; Thomas H. Whaley

[57] ABSTRACT

A strong, absorbent nonwoven fabric containing wood pulp and textile fibers is prepared by hydroentanglement with a continuous filament, base web. The fabric may be apertured or essentially nonapertured and may be made water repellant for use in medical and surgical applications.

14 Claims, 1 Drawing Sheet

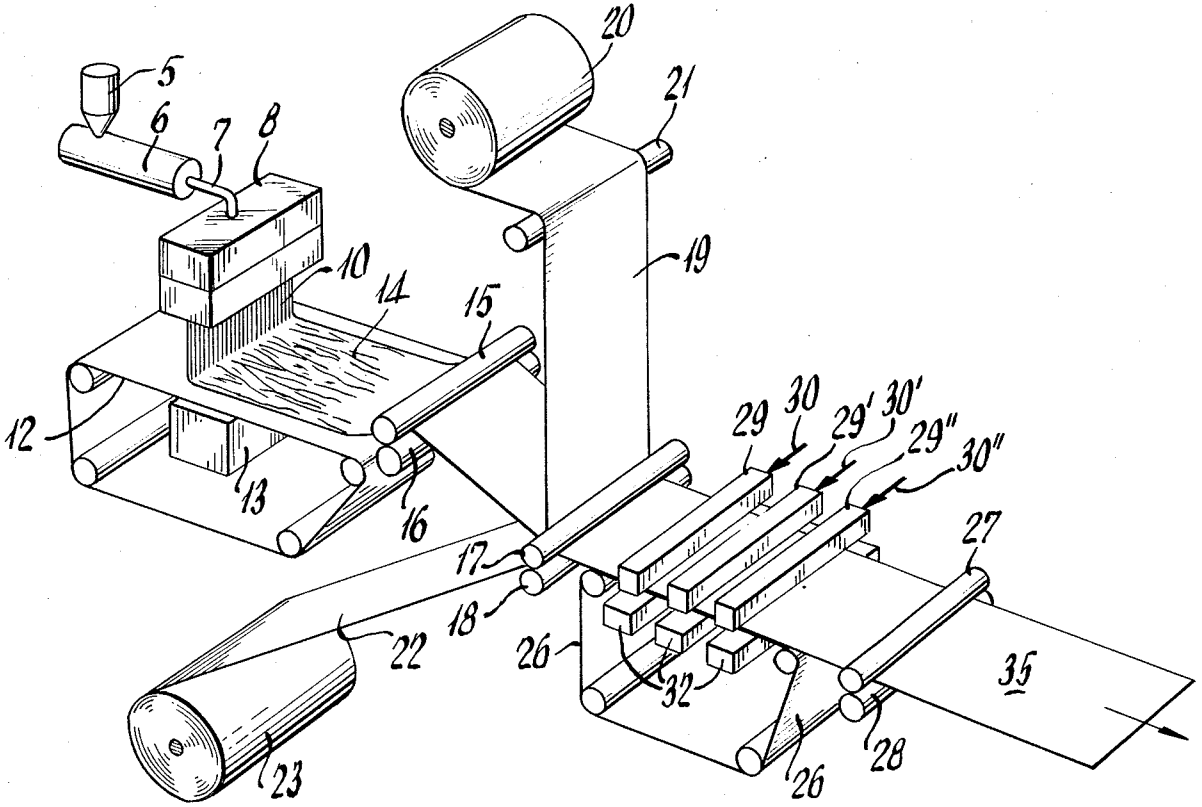
5
6
7
8
10
12
13
14
15
16
17
18
19
20
21
22
23
26
26
27
28
29
29'
29"
30
30'
30"
32
35

HIGH STRENGTH HYDROENTANGLED NONWOVEN FABRIC

This invention relates to high strength nonwoven fabrics containing wood pulp, and to methods of their preparation. In one of its more specific aspects, the present invention relates to a unique apertured or nonapertured composite fabric comprising a relatively high proportion of wood pulp fibers intimately entangled with staple fibers and with a web of continuous filament fibers. In one of its more specific aspects, a spunlaced fabric suitable for disposable medical applications is produced by hydraulically entangling wood pulp and staple fibers with a continuous filament base web producing a nonapertured high strength fabric, and treating the fabric with a fluorocarbon water repellant.

Composite webs made up of various combinations of fibers are known in the prior art. Nonwoven fabrics in which staple length textile fibers are hydroentangled with continuous filaments are disclosed in U.S. Pat. Nos. 3,494,821 and 4,144,370. In U.S. Pat. No. 4,623,576, staple fibers are blended with melt blown fibers during the blowing process to form a composite web. In U.S. Pat. Nos. 3,917,785 and 4,442,161, a layer of textile fibers, which may be mixed with wood pulp, is hydroentangled to form a non-woven fabric, while in U.S. Pat. No. 3,493,462, two layers of wood fibers and staple length rayon fibers are hydroentangled with a central web of unbonded continuous filaments to produce a leather substitute.

Nonwoven fibrous webs comprising mixtures of wood pulp and synthetic fibers have high moisture absorption capabilities and may be inexpensively produced by conventional papermaking procedures. However, such products also tend to have relatively low wet strength properties and lack sufficient strength for many applications, for example, for use as household cloths, food service wipes and industrial machinery wipes. The strength of such products may be improved by including a bonding agent in the fiber furnish or by application of an adhesive binder to the formed web. When the strength characteristics of the web are improved by use of an adhesive binder, such as a synthetic resin latex, the liquid absorption capability of the web is correspondingly decreased.

In accordance with the present invention, a high strength nonwoven absorbent fabr ic may be produced which comprises a web of continuous filament fibers and a soft, absorbent surface of wood pulp fibers mixed with staple length textile fibers intimately entangled with the continuous filament fibers. In one specific embodiment of this invention, a spunbonded web is formed in known manner and combined with an unbonded or lightly bonded air laid or water laid web of pulp and textile fibes by hydraulic entanglement. As a specific example, a water-laid web made up of 80 to 90 weight percent wood pulp fibers and 10 to 20 weight percent short, staple length polyethylene terephthalate (PET) fibers hydroentangled with a spunbonded web of continuous filament nylon produces a strong nonwoven fabric having excellent water absorption qualities. In another specific example of another embodiment of this invention, a wet laid web of wood pulp fibers and PET staple fibers is spunlaced with spunbonded polypropylene forming an absorbent oleophilic fabric useful in wiping oil and water based spills.

Staple fibers may range in length from three eighths inch to two inches and may include natural fibers, e.g., cotton, wool and synthetic fibers, including nylon, polyester, and the like. Fiber denier is usually about 1.2 to 2.0 denier per filament. The nonwoven fabrics of this invention containing a substantial proportion of wood pulp are strong when wet and highly absorbent, and do not require stabilization with a latex adhesive. The continuous filament base web may be produced by known methods from any of various synthetic resins including polyolefins, nylons, polyesters, and the like.

In a preferred embodiment of the present invention, a continuous filament base web and a separately formed fibrous layer or web composed of a mixture of wood pulp fibers and textile fibers are spunlaced into one another to provide a nonwoven fabric. The fibrous layer may be formed by any conventional web manufacturing process. For example, the web may be produced by a wet-laying process, or by air laying, or by other techniques utilized in the paper and nonwovens industries. In one preferred embodiment of this invention, the continuous filament web and the fibrous web are separately formed and brought together as separate layers or plies and then subjected to hydraulic entanglement to produce a single composite spunlaced fabric. A preferred method and apparatus for hydraulically entangling the fibers is disclosed in U.S. Pat. No. 3,494,821, incorporated herein by reference.

Preferably, the fibrous layer is produced by a classical, wet-laid papermaking method using any one of various, commonly practiced dispersant techniques to disperse a uniform furnish of wood pulp fibers and staple fibers onto a foraminous screen of a conventional papermaking machine. U.S. Pat. No. 4,081,319 to Conway and U.S. Pat. No. 4,200,488 to Brandon et al. disclose wet-laying methods which may be used to produce a uniform web of wood pulp and staple fibers. A preferred method of dispersing a mixture of staple fibers and wood pulp is disclosed in commonly assigned copending U.S. patent application Ser. No. 07/035,059 filed Apr. 6, 1987.

While various wood pulps may be incorporated into the finished fabric by hydroentanglement as disclosed herein, those pulps which are characterized by long, flexible fibers of a low coarseness index are preferred. Wood fibers with an average fiber length of three to five millimeters are especially suited for use in the spunlaced fabrics. Western red cedar, redwood and northern softwood kraft pulps, for example, are among the more desireable wood pulps useful in the nonwoven spunlaced fabrics.

Staple fiber length is an important factor affecting the abrasion resistance of the resulting fabric. Staple fibers which are either too short or too long do not entangle well with the continuous filament fibers of the base web. Staple fiber lengths in the range of from about three eighths inch to about one inch are suitable for use in the process of this invention. Staple fiber lengths in the range of from about one half inch to three quarters inch are preferred. The diameter of the fibers should be not greater than three denier for best results. Synthetic fibers of one and one half denier or less are preferred.

The wood pulp fiber content of the reinforced nonwoven web in accordance with the present invention may be in the range of from about 40 weight percent to about 90 weight percent. For most applications, a wood pulp content in the range from about 55 weight percent to 75 weight percent is preferred. The higher levels of wood pulp provide increased absorbency to the product usually with some loss of abrasion resistance.

The continuous filament base web preferably has a basis weight not greater than about 0.55 ounce per square yard. Preferably, the basis weight of the base web is in the range of 0.15 to 0.8 ounce per square yard. The polymers from which the continuous filaments are made can vary widely and can include any polymer or polymer blend capable of being melt spun. Among the acceptable polymers are polyethylene, polypropylene polyester and nylon. Bonding of the continuous filament web is essential when produced in a separate step, in which case the bonding area should not exceed about fifteen percent of the total area of the web for best results. Bonding in the range of six to ten percent area bonded is preferred.

In the present invention, the entangling treatment can be carried out under conventional conditions described in the prior art, for example, by the hydroentanglement process disclosed in U.S. Pat. Nos. 3,485,706 to F. J. Evans or 3,560,326 to Bunting Jr., et al., incorporated herein by reference. As known in the art, the product fabric may be patterned by carrying out the hydroentanglement operation on a patterned screen or foraminous support. Nonpatterned products also may be produced by supporting the layer or layers of fibrous material on a smooth supporting sur face during the hydroentanglement treatment as disclosed in U.S. Pat. No. 3,493,462 to Bunting, Jr. et al.

The basis weight of the finished fabric may range from about 0.8 ounce per square yard to about four ounces per square yard. The lower limit generally defines the minimum weight at which acceptable web strength (greater than one pound per inch strip tensile) can be attained. The upper limit generally defines the weight above which the water jets are not effective to produce a uniformly entangled web.

The continuous filament web may be supplied from a suitable source in rolls, unwound from a roll, layered with one or more webs of wood pulp and textile fibers, and hydroentangled. Alternatively, one or both webs may be produced on-site and fed directly from the web former to the hydroentangling apparatus without the need for drying or bonding of webs prior to entanglement. One or more separately formed webs containing the staple length textile fibers and wood pulp fibers is laminated with the continuous filament web on a foraminous screen or belt, preferably made up of synthetic continuous filaments woven into a screen. The combined webs are transported on the screen under several water jet manifolds of the type described in U.S. Pat. No. 3,485,706. The water jets entangle the discrete staple fibers and wood fibers present in the nonelastic web with the continuous filaments producing an intimately blended composite fabric. After drying, the resulting fabric is soft and is suitable for use in disposable personal care or health care applications, or as a durable, multiple use fabric. Food service and utility wipes made up of continuous filaments spunlaced with staple fibers and wood pulp are strong, absorbent and generally superior in service than similar products of latex bonded hydroentangled synthetic fibers.

Colored fabrics may be made up from dyed wood pulp, dyed or pigmented textile staple fibers and pigmented continuous filaments, particularly those of polypropylene.

Fluorochemically finished fabrics made up of continuous filaments spunlaced with staple fibers and wood pulp fibers are strong, water repellent, soft, pliable, clothlike in appearance and feel and are suitable for us in health care applications such a sterilization wrap, and operating room gowns and drapes. Additionally this fluorochemically treated fabric can be sterilized by currently known and commercially available sterilization processes, e.g., gamma irradiation, ethylene oxide gas, steam, and electron beam methods of sterilization.

One embodiment of a suitable method for making the nonwoven fabric of this invention is illustrated in the figure, which is a simplified, diagrammatic illustration of apparatus capable of carrying out the method of forming a nonwoven fabric in accordance with this invention. With reference to the figure, thermoplastic polymer pellets are placed in the feed hopper 5 of a screw extruder 6, where they are heated to a temperature sufficient to melt the polymer. The molten polymer is forced by the screw through conduit 7 into a spinning block 8. The elevated temperature of the polymer is maintained in spin block 8 by electric heaters (not illustrated). Polymer is extruded from the spin block 8 through a plurality of small diameter capillaries, for example capillaries having a diameter of about 0.015 inch, at a density of 30 capillaries per inch, and exit from the spinning block as filaments of molten polymer 10.

The filaments 10 are deposited onto a foraminous endless belt 12. Vacuum boxes 13 assist in the retention of fibers on the belt. The fibers form a coherent web 14 which is removed from the belt by a pair of pinch rolls 15 and 16. Bonding elements (not illustrated) may be included, but are not necessarily required, in rolls 15 and 16 to provide the desired extent of bonding of the continuous filaments.

The continuous filament web from consolidation rolls 15 and 16 is fed to rolls 17 and 18 where it is covered by a preformed web 19 comprising staple fibers and wood pulp fibers drawn from supply roll 20 over feed roll 21. A second preformed web 22 comprising staple fibers and wood pulp fibers is drawn from supply roll 23 over roll 18 onto belt 26. The layers of preformed webs, i.e., a continuous filament web 14 and the substantially nonelastic webs 19 and 22, are brought together at rolls 17 and 18 and carried on a foraminous carrier belt 26 formed of a flexible material, such as a woven polyester screen, through the hydroentanglement apparatus. The carrier belt 26 is supported on rolls, one or more of which may be driven by means not illustrated. A pair of rolls 27 and 28 remove the hydroentangled fabric from the belt 26 for drying and subsequent treatment.

Several orifice manifolds 29 are positioned above the belt 26 to discharge small diameter, high velocity jet streams of water onto the webs 22 and 14 as they move from rolls 20 and 21 to rolls 27 and 28. Each of the manifolds 29, 29' and 29'' is connected with a source of water under pressure through conduits 30, 30' and 30'', and each is provided with one or more rows of 0.005 inch diameter apertures spaced on 0.025 inch centers (to provide 40 orifices per linear inch) along the lowermost surface of the manifolds. The spacing between the orifice outlets of the manifolds and the web directly beneath each manifold is preferable in the range of from about one-quarter inch to about one-half inch. Water from jets issuing from the orifices and passing through the webs 22, 14 and the screen 25 is removed by vacuum boxes 32. Although only three manifolds are illustrated, as many as fourteen manifolds are preferred, the first two operating at a manifold pressure of about 200 psig and the remainder at pressures in the range of 400 to 1800 psig.

In the following examples 1 to 3, a 10×10, 0:062 caliper plain weave PET screen from National Wire Fabric Corporation having a warp size of 0.032 inch and a shute of 0.035 inch with an open area of 44 percent and an air permeability of 1255 cubic feet per minute is used as the carrier belt for the hydroentanglement operation.

EXAMPLE 1

A wet laid 41 lb./ream (1.98 oz./sq. yd.) web is prepared from a mixture of 60 weight percent long fiber northern softwood kraft pulp and 40 weight percent of 1.5 denier by three-quarter inch polyethylene terephthalate (PET) staple fibers. A 0.43 oz./sq. yd. commercially available spunbonded polypropylene web with a six percent area bond, sold under the trade name Celestra by the Nonwoven Division of James River Corporation, Richmond, Va., is laid on the 10×10 mesh PET screen and covered by the wet laid web. The webs are passed at a speed of 240 ft./min. under water jets from a series of ten manifolds each of which is provided with row of 0.005 inch diameter orifices spaced 0.025 inch apart extending across the full width of the webs. The fibers from the two webs are hydroentangled by subjecting them to the action of two rows of water jets operating at a manifold pressure of 200 psig, four rows at a manifold pressure of 600 psig, four at 1200 psig and four at 1800 psig.

Properties of the nonwoven fabric produced in this example are shown in Table I in comparison with the properties of the water laid web alone, and those of a commercially available all synthetic nonwoven fabric sold as a food service wipe.

TABLE I

| Specimen | Water Laid Web | Present Invention Example 1 | 100% Synthetic HEF Fabric |
|---|---|---|---|
| Basis Weight | | | |
| (oz/yd$^2$) | 1.85 | 2.22 | 2.48 |
| (g/yd$^2$) | 52.4 | 63.0 | 70.2 |
| Tensile (g/in) | | | |
| CD Dry | 806 | 3699 | 2692 |
| MD Dry | 691 | 5602 | 3862 |
| CD Wet | 132 | 2478 | 2172 |
| MD Wet | 176 | 4222 | 3009 |
| Tear (g) | | | |
| CD Dry | 562 | 1166 | 1152 |
| MD Dry | 520 | 776 | 894 |
| CD Wet | 148 | 2090 | 904 |
| MD Wet | 172 | 1970 | 700 |
| Taber Abrasion | | | |
| Top Dry | 33 | | |
| Bottom Dry | 28 | | |
| Top Wet | 22 | | |
| Bottom Wet | 17 | | |
| Geometric Mean | | 483 | 214 |
| Thickness | | | |
| Caliper Dry | 111 | 132 | 103 |
| Caliper Wet | 93 | 112 | 101 |
| Loft | 39.8 | 46.4 | 32.7 |
| Absorption | | | |
| Capacity (g/in$^2$) | 0.309 | 0.274 | 0.28 |
| Capacity (%) | 928 | 651 | 594 |
| Rate (sec) | 0.26 | 0.5 | 0.2 |
| Wipe Dry (sec) | 23.3 | 76.4 | 77.9 |
| Wiping Efficiency Rating | — | 4.2 | 3.8 |
| Fuzz Test | | | |
| Top (mg) | 17.7 | 0.00 | 0.00 |

TABLE I-continued

| Specimen | Water Laid Web | Present Invention Example 1 | 100% Synthetic HEF Fabric |
|---|---|---|---|
| Bottom (mg) | 8.55 | 0.10 | 0.00 |

EXAMPLES 2 & 3

Spunlaced fabrics were produced by the method of Example 1 using the same water laid web of 40 weight percent PET and 60 weight percent northern softwood kraft fibers hydroentangled with a continuous filament 0.175 ounce per square yard nylon web sold under the trade name Cerex PBNII by James River Corporation, and a 0.43 ounce per square yard spunbonded polypropylene web sold under the trade name Celestra I by James River Corporation.

The physical properties of these fabrics are shown in Table II.

TABLE II

| Specimen | Example 2 Nylon Base Web | Example 3 Polypropylene Web |
|---|---|---|
| Basis Weight | | |
| (oz/yd$^2$) | 54.9 | 73.1 |
| (g/yd$^2$) | 1.94 | 2.58 |
| Tensile (g/in) | | |
| CD Dry | 1655 | 5236 |
| MD Dry | 3096 | |
| CD Wet | 415 | |
| MD Wet | 975 | |
| Tear (g) | | |
| CD Dry | 1094 | |
| MD Dry | 1466 | |
| CD Wet | 1268 | |
| MD Wet | 2000 | |
| Taber Abrasion | | |
| Geometric Mean (Top & Bot; Wet & Dry) | 165 | 577 (top, dry) |
| Thickness | | |
| Caliper Dry | 104 | |
| Caliper Wet | 91 | |
| Loft | 40.5 | |
| Absorption | | |
| Capacity (g/in$^2$) | 0.264 | 0.315 |
| Capacity (%) | 762 | |
| Rate (sec) | 0.2 | |
| Wipe Dry (sec) | 26.6 | |
| Fuzz Test | | |
| Top (mg) | 3.4 | |
| Bottom (mg) | 0.4 | |

In the foregoing examples, the tensile strength, reported in grams per inch of width is determined by repeated tests of one inch wide by five inch strips in an Instron Model 4201 tensile tester. Tear, reported in grams, is measured by an Elmendorf tear tester using single ply test strips. Caliper is measured on a four ply sample with a TMI Model 551 micrometer and is reported in mils. Loft, reported in mils, is determined with an Aimes 212.5 loft tester on a single ply of the specimen. Absorptive Capacity, reported in grams per square inch, is measured by the INDA wiping efficiency test IST 190.0-85 as is the Wipe Dry Time, reported in seconds.

The Taber Abrasion test is performed with a Taber Abrasion Tester Model 503, results are reported in cycles to failure.

Absorptive Rate, reported in seconds, is the measure of the time required for one milliliter of water to complettely absorb into the fabric.

Fuzz measures the linting resistance of nonwoven fabrics, and is determined by rubbing a material sample with an abrasive sponge and measuring the amount of fibers collected after 20 cycles and it is reported in milligrams.

Wiping Efficiency Rating is a subjective rating with an arbitrary scale of 1 to 5 ranging from 1=poor to 5=superior.

EXAMPLE 4

In this example, a fabric suitable for medical applications is produced from a six percent bonded, 0.3 ounce per square yard continuous filament nylon web of 3.5 denier per filament marketed under the trade name Cerex III by James River Corporation of Virginia, Richmond, Va. The continuous filament nylon web is placed between two 0.9 oz./sq. yd. wet laid webs containing by weight 35 percent bleached sisal, 35 percent bleached debonded sulfite pulp and 30 percent three quarters inch by 1.2 denier polyethylene terephthalate (PET) fibers.

The composite laminate comprising the nylon web sandwiched between two preformed wet laid webs is supported on a tightly woven, 98×96, plain weave, 0.080 caliper polyester transfer belt, having a warp of 0.0059 inch filament diameter and a shute of 0.0079 inch filament diameter with an open area of 14.8 percent and an air permeability of 200 cubic feet per minute. The fibers are subjected to two passes under the hydraulic jets at 200 psig, six passes at 800 psig on the face side of the fabric and four passes at 800 psig on the reverse side. The resulting composite fabric has a nonapertured appearance, and is soft and pliable.

A fluorocarbon water repellant finish is applied to the resultant fabric; the properties of the finished fabric are shown in the Table III, in comparison with a commercially available woven fabric marketed under the trade name Sontara by E.I. DuPont De Nemours and Company, Wilmington, Del.

TABLE III

| | This Invention | Comparison Fabric |
|---|---|---|
| Basis Weight (oz./sq. yd.) | 2.2 | 1.9 |
| Grab Tensile (lb.) | | |
| MD | 23 | 23 |
| CD | 16 | 16 |
| Grab Elongation (%) | | |
| MD | 58.5 | 28.5 |
| CD | 89.4 | 95.0 |
| Elmendorf Tear (g) | | |
| MD | 2640 | 1088 |
| CD | 2368 | 1280 |
| Mullen Burst (PSI) | 28 | 30 |
| Frazier Air Permeability (CFM/sq.ft.) | 148 | 120 |
| Water Impact (g) | 1 | 4 |
| Hydrostatic Head (cm) | 21 | 20 |
| Mason Jar (min) | 60+ | 60+ |
| Handle-O-Meter MD | 26 | 33 |
| (4 × 7) ¾" Gap CD | 16 | 8 |
| Particle Count, Gelbo Flex 10-Min. Count (1 Micron & Larger) | 809 | 1535 |

EXAMPLE 5

In this example, a fabric suitable for medical applications as a gauze replacement is produced from a 0.175 ounces per square yard continuous filament nylon web of 3.5 denier per filament marketed under the trade name Cerex PBNII by James River Corporation of Virginia, Richmond, Va. The continuous filament nylon web is laid on a 30×26 mesh PET screen, and covered by a 1.06 ounces per square yard wet laid web containing by weight 35 percent bleached sisal, 35 percent bleached debonded sulfite wood pulp, and 30 percent ¾ inch by 1.2 denier polyethylene terphthalate (PET) fibers.

The webs are supported on a ½ twill woven, 30×26 polyester transfer belt, having a warp of 0.0177 inch filament, and a shute of 0.0197 inch filament with an open area of 22.9 percent and an air permeability of 590 cubic feet per minute.

The fibers are subjected to two rows of hydraulic jets at 200 psig and eight rows of hydraulic jets at 600 psig. The resulting apertured fabric has a gauze like appearance and is soft and pliable.

The properties of the fabric are shown in table IV.

TABLE IV

| | |
|---|---|
| Basis weight (oz/sq.yd) | 1.2 |
| Grab Tensile (lb) MD | 9.3 |
| Dry CD | 5.4 |
| Grab Elongation (%) MD | 50 |
| Dry CD | 78 |
| Elmendorf Tear (GM) MD | 990 |
| Dry CD | 440 |
| Elmendorf Tear (GM) MD | 320 |
| Wet | 345 |
| Mullen Burst (PSI) | 26 |
| Thickness (MILS) | 18 |
| Absorption Capacity (%) | 900 |

EXAMPLE 6

In this example a fabric suitable for medical applications is produced from a 0.175 ounces per square yard continuous filament nylon web of 3.5 denier per filament marketed under the trade name Cerex PBNII by James River Corporation of Virginia, Richmond Va.

The continuous filament nylon web is laid onto a tightly woven 98×96, plain weave, 0.080 caliper polyester transfer belt, having a warp of 0.0059 inch filament diameter and a shute of 0.0079 inch filament diameter, with an open area of 14.8 percent and an air permeability of 200 cubic feet per minute, and covered by a 1.4 ounces per square yard wet laid web containing by weight 80 percent bleached debonded sulf ite wood pulp, and 20 percent ¾ inch×1.5 denier polyethylene terephthalate (PET) fibers.

The fibers are subjected to two passes under the hydraulic jets at 200 psig, and six passes under the hydraulic jets at 800 psig. The resulting fabric has a non-apertured appearance, and is soft and pliable. The fabric properties are shown in Table V.

TABLE V

| | |
|---|---|
| Basis weight (oz/sq.yd) | 1.6 |
| Grab Tensile (lb) MD | 19.1 |
| Dry CD | 13.8 |
| Grab Elongation (%) MD | 54 |
| Dry CD | 75 |
| Elmendorf Tear (GM) MD | 940 |
| Dry CD | 1280 |
| Mullen Burst (PSI) | 33 |
| Thickness (MILS) | 18 |
| Frazier Air Permeability (CFM/sq.yd) | 248 |

TEST PROCEDURES

Mullen Burst=Bursting strength ASTM-D3786-80a

This test method covers the determination of the resistance of textile fabrics to bursting using the hydraulic diaphragm bursting tester.

Bursting strength=the force or pressure required to rupture a textile structure, by distending it with force, applied at right angles to the plane of the fabric; reported in pounds per square inch of force to rupture.

Frazier Air Permeability ASTM - D737-75

This test method covers the direct determination of air permeability of textile structures by the calibrated orifice method.

Air Permeability=is the rate of air flow through a material under a differential pressure between the textile structure surfaces. The measurement is expressed in cubic feet of air per minute per square foot of material at a differential pressure of 0.5 inches of water.

Handle-O-Meter TAPPI Method T490; INDA Standard Test 90.0–75

This test method assesses the quality of "Hand", which includes a combination of surface friction and flexural rigidity of textile materials.

The Handle-O-Meter measures the peak force in grams required to push a sample material into a predetermined slot opening at a predetermined stroke length.

Hydrostatic Head AATCC Method 127-1977

This method covers the determination of the resistance of textile fabrics to water genetration under constantly increasing hydrostatic pressure.

Hydrostatic head measures thye height in centimeter of a column of water which textile materials can support prior to water penetration through the fabric.

Mason Jar INDA Standard Test Method 80.7–70

This test method covers the determination of the resistance of textile fabrics to penetration of water under a constant hydrostatic pressure.

Mason jar measures the elapsed time in minutes to water (liquid) penetration through the fabric.

Gelbo Flex Test INDA Standard Test Method 160.0–83

This test method covers the determination of the number of lint particles emitted from a textile fabric during continuous twisting and flexing action.

It measures the number of particles emitted from a continuously flexed and twisted material for a given period in minutes, and a predetermined particle size measured in microns.

We claim:

1. A high strength nonwoven fabric comprising a continuous filament bonded base web and a wet laid second fibrous web consisting essentially of 50 to 90 weight percent wood pulp and 10 to 50 weight percent staple length fibers intimately hydroentangled with one another and with said base web.

2. A nonwoven fabric according to Claim 1 wherein the dry weight ratio of wet laid fibers to continuous filament base web fibers is in the range of about 3 to about 15.

3. A composite non-woven fabric according to Claim 1 wherein the dry weight ratio of wet laid fibers to continuous filament base web fibers is in the range of about 5 to 10.

4. A nonwoven fabric according to Claim 1 wherein the continuous filament of the base web is of polypropylene.

5. A nonwoven fabric according to Claim 1 wherein the continuous filament of the base web is of nylon.

6. A nonwoven fabric according to Claim 1 wherein the continuous filament of the base web is of polyester.

7. A composite nonwoven fabric according to Claim 1, wherein the continuous filament base web is a bonded web with a bonding area in the range of from about six to about twenty-five percent of the total area of the web.

8. A nonwoven fabric according to Claim 1 wherein the staple length fibers of the second web are selected from the group consisting of cotton, wool, rayon, polyamides, polyolefins, polyesters, and acrylic fibers.

9. A nonwoven fabric according to Claim 1 wherein the staple length fibers are in the range of 0.8 to 6 denier per filament and a length in the range of three eighths inch to two inches.

10. A nonwoven fabric according to Claim 1 wherein the basis weight of the continuous filament base web is in the range of from about 0.15 to 0.8 ounce per square yard.

11. A nonwoven according to claim 1 having a basis weight in the range of from about 0.8 to about 4 ounces per square yard.

12. A nonwoven fabric according to claim 1 having a fluorocarbon water repellant finish applied after hydroentanglement of the fibers.

13. A composite nonwoven fabric comprising 15 to 25 weight percent of a bonded continuous filament web, wherein the bonded area is within the range of 5 to 25 percent, and 75 to 85 weight percent mixed fibers consisting essentially of 50 to 90 weight percent softwood paermaking fibers and 10 to 50 weight percent staple length fibers hydroentangled with one another.

14. A method of making a nonwoven fabric comprising cellulosic papermaking fibers, wood pulp and staple length fibers reinforced with a web of continuous filament fibers which comprises laminating a plurality of water laid webs containing 45 to 90 weight percent wood. pulp and 55 to 10 weight percent staple length synthetic fibers basis the dry weight of the fibers, with a continuous filament synthetic fiber web, subjecting the resulting multi-layer web to hydroentanglement forming a composite web of entangled fibers, and drying said composite web to form said nonwoven fabric.

* * * * *